US006551178B1

(12) United States Patent
Tanaka et al.

(10) Patent No.: US 6,551,178 B1
(45) Date of Patent: Apr. 22, 2003

(54) REAMER WITH ADJUSTABLE EXPANSION/ CONTRACTION, AND BORE FINISHING MACHINE COMPRISING THE SAME

(75) Inventors: Junichi Tanaka, Nagaoka (JP); Toshiyuki Nomoto, Nagaoka (JP); Eiji Takezawa, Fujioka-machi (JP)

(73) Assignees: Kabushiki Kaisha Takezawa Seiki, Tochigi-ken (JP); Kuraki Co., Ltd., Niigata-ken (JP)

( * ) Notice: Subject to any disclaimer, the term of this patent is extended or adjusted under 35 U.S.C. 154(b) by 7 days.

(21) Appl. No.: 09/675,947

(22) Filed: Sep. 29, 2000

Related U.S. Application Data

(62) Division of application No. 09/395,019, filed on Sep. 13, 1999, now Pat. No. 6,203,410.

(30) Foreign Application Priority Data

Sep. 14, 1998 (JP) ..... 10-279378
Sep. 14, 1998 (JP) ..... 10-279379
Oct. 5, 1998 (JP) ..... 10-299172

(51) Int. Cl.[7] ..... B24B 9/02

(52) U.S. Cl. ..... 451/180; 451/51; 451/61; 451/478; 451/504

(58) Field of Search ..... 451/180, 478, 451/482, 483, 65, 47, 61, 507, 470, 471, 472

(56) References Cited

U.S. PATENT DOCUMENTS 2,031,156 A 2/1936 Gillett et al.
4,291,504 A 9/1981 Fitzpatrick et al.
4,424,648 A 1/1984 Largeteau
5,269,103 A 12/1993 Nagel et al.
5,371,978 A 12/1994 Higashikawa
5,482,498 A 1/1996 Higashikawa
5,871,391 A * 2/1999 Pryor ..... 451/9
6,203,410 B1 * 2/2001 Tanaka et al. ..... 451/51

FOREIGN PATENT DOCUMENTS

JP 3-29065 6/1991
JP A-9-300204 11/1997

* cited by examiner

*Primary Examiner*—Lee Wilson
(74) *Attorney, Agent, or Firm*—Weingarten, Schurgin, Gagnebin & Lebovici LLP

(57) ABSTRACT

A reamer with adjustable expansion/contraction and a bore finishing machine comprising the reamer. The reamer has a rotation shaft that is externally operable and a grinding section. The grinding section is cylindrically shaped, and has a plurality of axially-extending slits in its peripheral wall and a tapered inner surface. The rotation shaft is connected via threaded sections to a sliding shaft, which is in turn connected to a diameter expansion member consisting of a tapered cone fitted into the tapered inner surface of the grinding section. When the rotation shaft is operated to rotate, the rotational motion is converted into linear motion of the slide shaft due to a guide pin and a guide hole. The linear motion moves the diameter expansion member back and forth inside the grinding section, thereby contracting/ expanding the outer diameter of the grinding section mechanically and precisely. The bore finishing machine has a hollow main rotation spindle, and a rotation spindle inside the same. The main rotation spindle holds and rotates the reamer for grinding. The rotation spindle rotates the rotation shaft of the reamer to adjust the outer diameter of the grinding section mechanically and precisely. The bore finishing machine is also provided with a vibration applicator for application of axial vibration to the main rotation spindle, so that the reamer is axially stroked in grinding, resulting in further improved grinding accuracy.

8 Claims, 6 Drawing Sheets

REAMER WITH ADJUSTABLE EXPANSION/CONTRACTION, AND BORE FINISHING MACHINE COMPRISING THE SAME

CROSS REFERENCE TO RELATED APPLICATION

This application is a divisional application of U.S. patent application Ser. No. 09/395,019 filed Sep. 13, 1999 U.S. Pat. No. 6,203,410, which disclosure is incorporated by reference.

BACKGROUND OF THE INVENTION

1. Field of the Invention

The invention relates to a reamer having a grinding section with adjustable expansion/contraction and a bore finishing machine comprising the reamer, which are to be employed for finishing of surfaces such as the inner surfaces of cut holes and the inner surfaces of cylinders with high accuracy.

2. Background Art

A reamer having a grindstone section with adjustable expansion/contraction is already known from the specification of U.S. Pat. No. 5,482,498 and from Japanese Utility Model Publication No. Hei 3-29065. According to these documents, the inner peripheral surface of the grindstone section is formed as a tapered surface, a tapered cone or a ball is inserted thereinto, and the tapered cone or the ball is shifted up and down in position with jigs to expand/contract the outer diameter of the grindstone section.

Such adjustment expansion of the diameter with jigs is carried out by hand each time, and the degree of adjustment is slight. A considerable amount of skill is required for the adjustment. It also entails the troublesome process of making several trials of grinding with the diameter-adjusted reamer mounted on the rotation spindle of a grinding machine before final adjustment.

SUMMARY OF THE INVENTION

To solve the aforesaid problems of the prior art, it is an object of the present invention to provide a new configuration of a reamer with adjustable expansion/contraction, in which the diameter expansion/contraction of the reamer's grinding section can be carried out not only using jigs and hands but mechanically despite of adopting a tapered surface as conventional.

Another object of the present invention is to provide a new configuration for a reamer with adjustable expansion/contraction, in which the rotational motion of the main rotation spindle from a motor can be converted into a linear motion from a slide shaft installed in the reamer to mechanically carry out the diameter expansion/contraction of a grinding section of the reamer after the reamer is mounted on a grind finishing machine.

It is yet another object of the present invention to provide a new bore finishing machine comprising a reamer having a grinding section with adjustable expansion/contraction, in which the bore finishing machine can carry out the expansion/contraction adjustment of the reamer's grinding section as well as grind finishing with the reamer, wherein up-and-down vibration can be applied to a reamer-mounted main rotation spindle by adopting a slanting disk without using an eccentric cum, a spring or a crank.

The foregoing objects and other objects of the present invention have been achieved by the provision of a reamer with adjustable expansion/contraction comprising: a reamer body composed of a hollow shuttle section and a cylindrically shaped grinding section, the shuttle section having a rotation shaft with a built-in threaded cylinder designed so as to be externally operable, the grinding section having a plurality of axially-extending slits provided at equal intervals in its peripheral wall and having a tapered inner peripheral surface extending from the upper section of the slits to an opening end thereof; and a slide shaft provided inside the reamer body, having a threaded shaft at one end and an axial guide hole in the middle section thereof and being connected with a diameter expansion member at the other end thereof. Here, the slide shaft and the rotation shaft are threadedly engaged and connected to each other inside the shuttle section via the threaded shaft, and a guide pin is inserted from the shuttle-section side through the guide hole to convert the rotational motion of the rotation shaft into linear motion of the slide shaft so that the diameter expansion member which is moved with the slide shaft in an axial direction is capable of freely adjusting the outer diameter of the grinding section.

In addition, the grinding section is composed of a diamond grindstone bonded to a base material. The diamond grindstone is of the most appropriate particle size and density selected in accordance with the material and hardness of the particular object to be worked. The diameter expansion member is composed of a tapered cone having an outer peripheral wall formed into the same tapered surface as the tapered inner peripheral surface of the grinding section and a bottom surface with an outer diameter that is approximately the same as the inner diameter of the opening section of the grinding section. Here, the diameter expansion member is integrally connected to the other end of the slide shaft with a bolt that is bolted into the bottom surface thereof so as to be axially moved inside the grinding section with the slide shaft by force.

The foregoing objects and other objects of the present invention have been achieved by the provision of a bore finishing machine comprising a reamer with adjustable expansion/contraction, further comprising: a hollow main rotation spindle for grinding, having a holding section for a reamer body at its lower end and rotatably supported with a housing that can be oriented longitudinally, the housing held with a column so as to be freely liftable upward and downward; a rotation spindle for expansion/contraction of the diameter of the reamer, which is inserted and supported rotatably inside the main rotation spindle, having a pinion on the upper end projecting from the main rotation spindle and having its lower end formed into a joint for connection with a rotation shaft in the reamer body, the connection being provided inside the main rotation spindle; an intermittent gear for intermittent meshing with the pinion to rotate the pinion with the rotation spindle by a set rotational angle; a localization sensor which detects the position of a tooth tip of the intermittent gear and sends out a signal to halt the activation of a drive source for the intermittent gear so that the intermittent gear is always halted out of the meshing point; a main motor for rotation of the main rotation spindle via a transmission mechanism, the main motor being situated on the housing; and a motor for rotation of the rotation spindle via the intermittent gear and the pinion. Here, the rotational motion of the rotation shaft at the lower end of the rotation spindle from the motor is converted into the linear motion of a slide shaft which is screw-threaded with the rotation shaft inside the reamer so that a diameter expansion member on one end of the slide shaft inside the reamer body is capable of adjusting the outer diameter of the grinding section of the reamer.

The transmission mechanism is composed of a rotation cylinder which drives the main rotation spindle and is rotatably supported with the housing while being oriented longitudinally, a transmission shaft situated in the housing so as to be parallel to the rotation cylinder and connected with the drive shaft of the main motor, pulleys integrally arranged on the transmission shaft and on the rotation cylinder at its outer periphery between the rotatably supported sections, respectively, and a belt wound around the pulleys. Also, the rotation cylinder has the main rotation spindle inserted therethrough, and the main rotation spindle is connected with the rotation cylinder via a key member so as to be integral with the rotation cylinder in a rotating direction and movable in an axial direction so that the main rotation spindle can be freely rotated and vertically moved with the rotation spindle for the reamer-diameter expansion accomplished inside thereof.

The bore finishing machine further comprises a vibration applicator for the main rotation spindle composed of: a block-shaped vibrating member for rotatable holding of an upper section of the main rotation spindle passing therethrough; a pair of upper and lower sandwich-supporting rollers provided on one side of the vibrating member and spaced apart by a sandwiching gap; a spinning shaft longitudinally provided inside the housing, which faces the sandwich-supporting rollers and is parallel to the main rotation spindle; a vibrating disk fitted to the spinning shaft with its periphery inserted in the sandwiching gap in a freely tiltable manner and connected with the vibrating member via the pair of sandwich-supporting rollers; a rotating disk fitted and immovably attached to a lower section of the spinning shaft below the vibrating disk, being spaced from the vibrating disk by a required gap; and a joint for connection between the rotating disk and the vibrating disk at their eccentric sections to support the vibrating disk slantingly against the rotating disk with the connecting point as the fulcrum.

The joint is composed of: sleeves fitted to hole sections at the eccentric sections of the vibrating disk and the rotating disk, respectively; spherical bearings installed in the respective sleeves; a connecting shaft consisting of a bolt inserted across the vibrating disk and the rotating disk so as to pass through the bearings; and a nut.

The joint also comprises a circular scale plate fixed to the upper end of the sleeve on the vibrating disk side, and an index member provided on the connecting shaft projecting from a side facing the scale plate, so as to set the vibrating disk at an angle based on the degree of rotation of the connecting shaft indicated by the scale plate and the index member.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
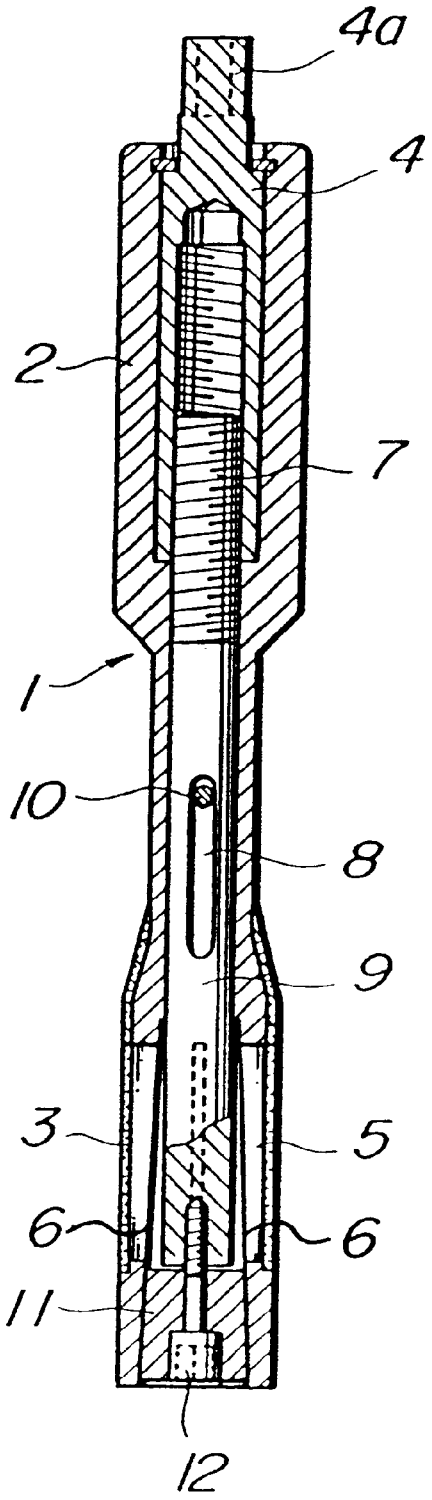
FIG. 1 is a longitudinal sectional front view showing a reamer with adjustable expansion/contraction according to the present invention before the diameter expansion.
Figure 2:
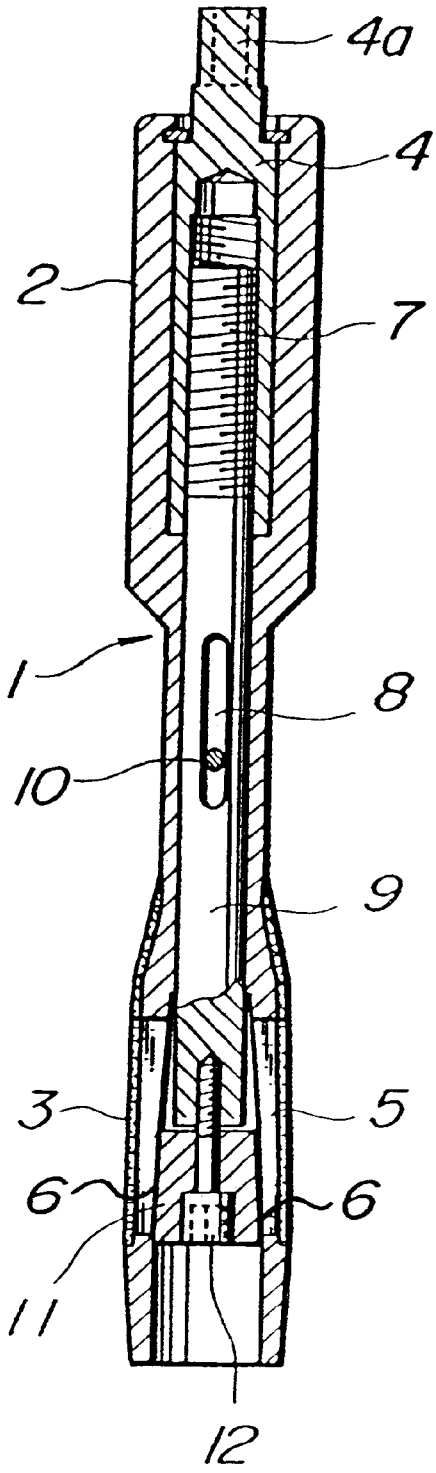
FIG. 2 is a longitudinal sectional front view of the same being expanded in diameter.

FIGS. 1 and 2 show an embodiment of a reamer with adjustable expansion/contraction according to the present invention. In the drawings, reference numeral 1 indicates a reamer body, which is composed of a hollow shuttle section 2 and a cylindrical grinding section 3 connected to one end section of the same.

The aforesaid shuttle section 2 has a rotation shaft 4 with a threaded cylinder mounted on its end section on the opposite side from the grinding section 3 so as to be operable externally. The grinding section 3 is composed of a diamond grindstone electrically deposited onto a base material. Here, the diamond grindstone has the most appropriate particle size and density selected in accordance with the material and hardness of the particular object to be worked. The grinding section 3 has four axially-extending slits 5 provided at equal intervals in its peripheral wall. An inner peripheral surface 6 of the grinding section 3 is formed into a tapered surface (grade of 1/20~1/100) extending from the upper section of the slits to its opening end.

A slide shaft 9 having a threaded shaft 7 at one end and a guide hole 8 in a middle section thereof is inserted into the reamer body 1 through the opening end of the grinding section 3 with the threaded shaft 7 and the aforesaid rotation shaft 4 threadedly engaged with each other, and connected with the rotation shaft 4 inside the shuttle section 2. In addition, a guide pin 10 is inserted from the shuttle-section side into the guide hole 8 so that the slide shaft 9 is moved only in axial directions. To the other end of the slide shaft 9 there is connected a diameter expansion member 11 by a bolt 12 bolted in a bottom surface thereof. Here, the diameter expansion member 11 is composed of a tapered cone with its outer peripheral wall formed into the same tapered surface as the tapered inner peripheral surface of the aforesaid grinding section 3 and the bottom surface of approximately the same outer diameter as the inner diameter of the opening section of the grinding section 3, and it is fitted inside the opening end.

In a reamer of such constitution, when a connection terminal 4*a* projecting from the end surface of the shuttle section 2 is rotated by external operation which rotates the aforesaid rotation shaft 4, the rotational motion of the rotation shaft 4 is converted into linear motion of the slide shaft 9 since the slide shaft 9 threadedly engaged to the rotation shaft 4 via the threaded shaft 7 is hampered in its rotation by the guide pin 10 in the guide hole 8. As a result, the slide shaft 9 is shifted inside the reamer body 1 together with the diameter expansion member 11 in the opening section.

The degree of motion of the slide shaft 9 is in proportion to the number of rotations of the rotation shaft 4; that is, the greater the number of rotations, the greater the degree of motion. Here, right-handed rotation of the rotation shaft 4 advances the slide shaft 9 inward, so that the diameter expansion member 11 is moved inward pressing the peripheral wall of the grinding section 3 outward.

Since in the grinding section 3 the peripheral wall is split by the slits 5, the pressing force stretches out the peripheral wall, as shown in FIG. 2, expanding the outer diameter thereof. While the figure shows exaggerated expansion of the diameter, actual expansion of diameter is accomplished within a range of 0.001 mm to 0.2 mm.

On the other hand, with left-handed rotation the slide shaft 9 is returned outward to push the diameter expansion member 11 back, thus removing the pressing force against the peripheral wall so that the outer diameter of the grinding section 3 is contracted to its ordinary outer diameter. Therefore, simple rotation of the aforesaid rotation shaft 4 in either the right-handed or left-handed direction can expand or contract the outer diameter of the grinding section 3 mechanically. The outer diameter thereof can also be freely adjusted by controlling the number of rotations.

Figure 3:
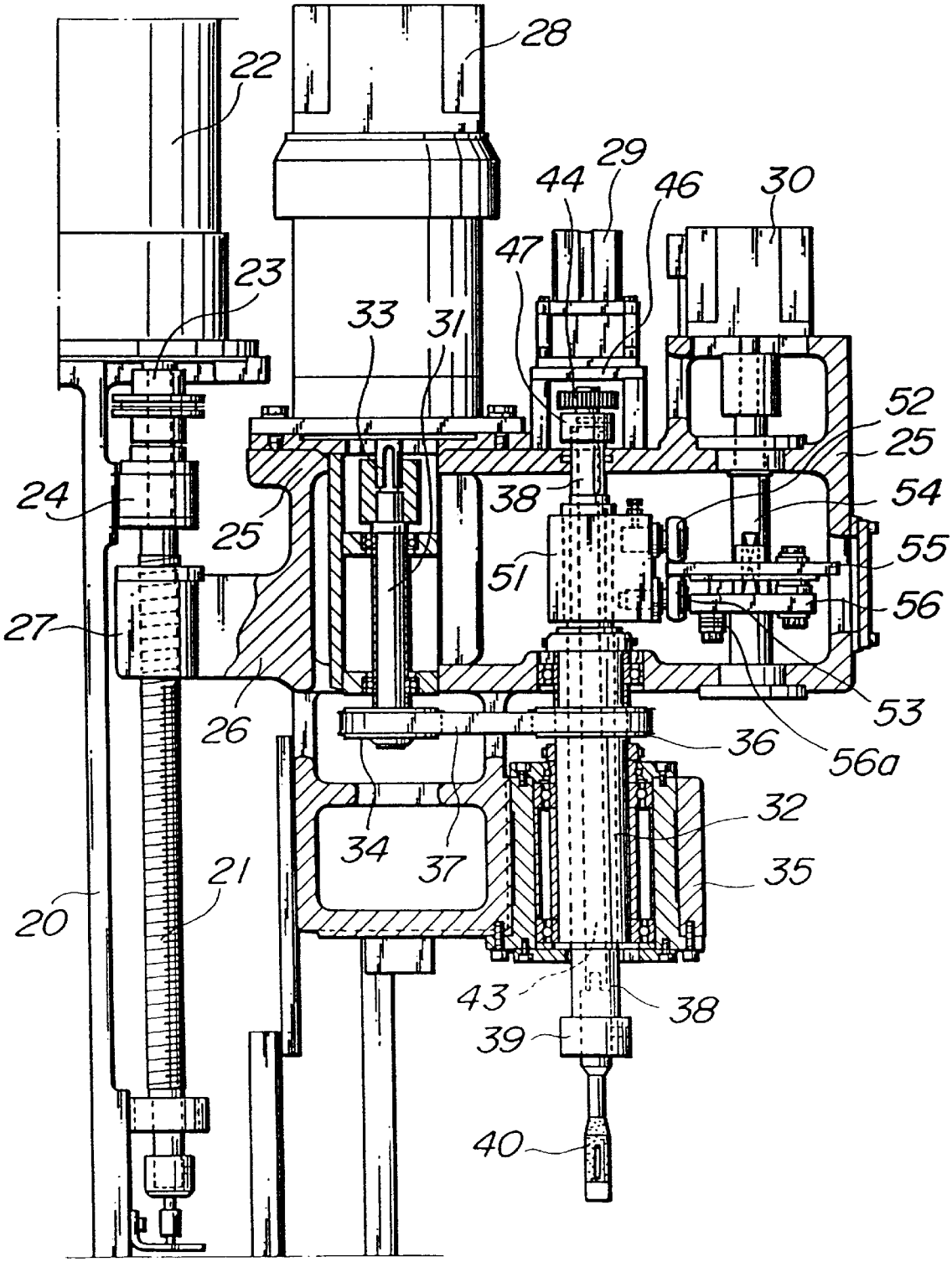
FIG. 3 is a schematic side view showing a bore finishing machine comprising the reamer according to the present invention with its housing longitudinally sectioned.

FIG. 3 and the following drawings show an embodiment of a bore finishing machine comprising the aforesaid reamer.

In the drawings, reference numeral 20 indicates a column of the bore finishing machine, adjacent to which there is rotatably juxtaposed a threaded shaft for lifting 21. The upper end of the threaded shaft for lifting 21 is connected via a coupler 24 to a drive shaft 23 of a lifting motor 22 situated on the top of the column 20.

Reference numeral 25 indicates a drive unit housing of the bore finishing machine, wherein a nut section 27 threadedly engaged with the aforesaid threaded shaft for lifting 21 is situated adjacent to the column 20 in a freely liftable manner. Here, the nut section 27 is integrally provided on the extremity of an arm 26 so as to project from one end surface of the housing 25.

As shown in FIG. 3, on the top of the housing 25 there are arranged in parallel respective motors, in the order of a main motor 28 for rotational driving of the reamer, an adjusting motor 29 with a decelerator for the reamer's grinding section, and a motor 30 for vibration of the reamer.

Inside the housing 25 under the main motor 28, a transmission shaft 31 is supported rotatably with the housing 25 and is situated longitudinally and in parallel to a rotation cylinder 32 for driving of a main rotation spindle. The transmission shaft 31 is connected to the upper end to a drive shaft 33 of the motor 28, and has a toothed pulley 24 mounted on its lower end.

The aforesaid rotation cylinder 32 is rotatably supported at a plurality of upper and lower points ranging from the housing 25 under the adjusting motor 29 to a bearing member 35 fixed to a lower part of the housing, and it is situated longitudinally. To the outer periphery of the rotation cylinder 32 between the bearing sections there is fittedly attached a toothed pulley 36, and a timing belt 37 is wound around the toothed pulley 36 and the aforesaid toothed pulley 34 at the end of the transmission shaft, thereby constituting a transmission mechanism for rotation of the rotation cylinder 32 by the aforesaid main motor 28.

Figure 4:
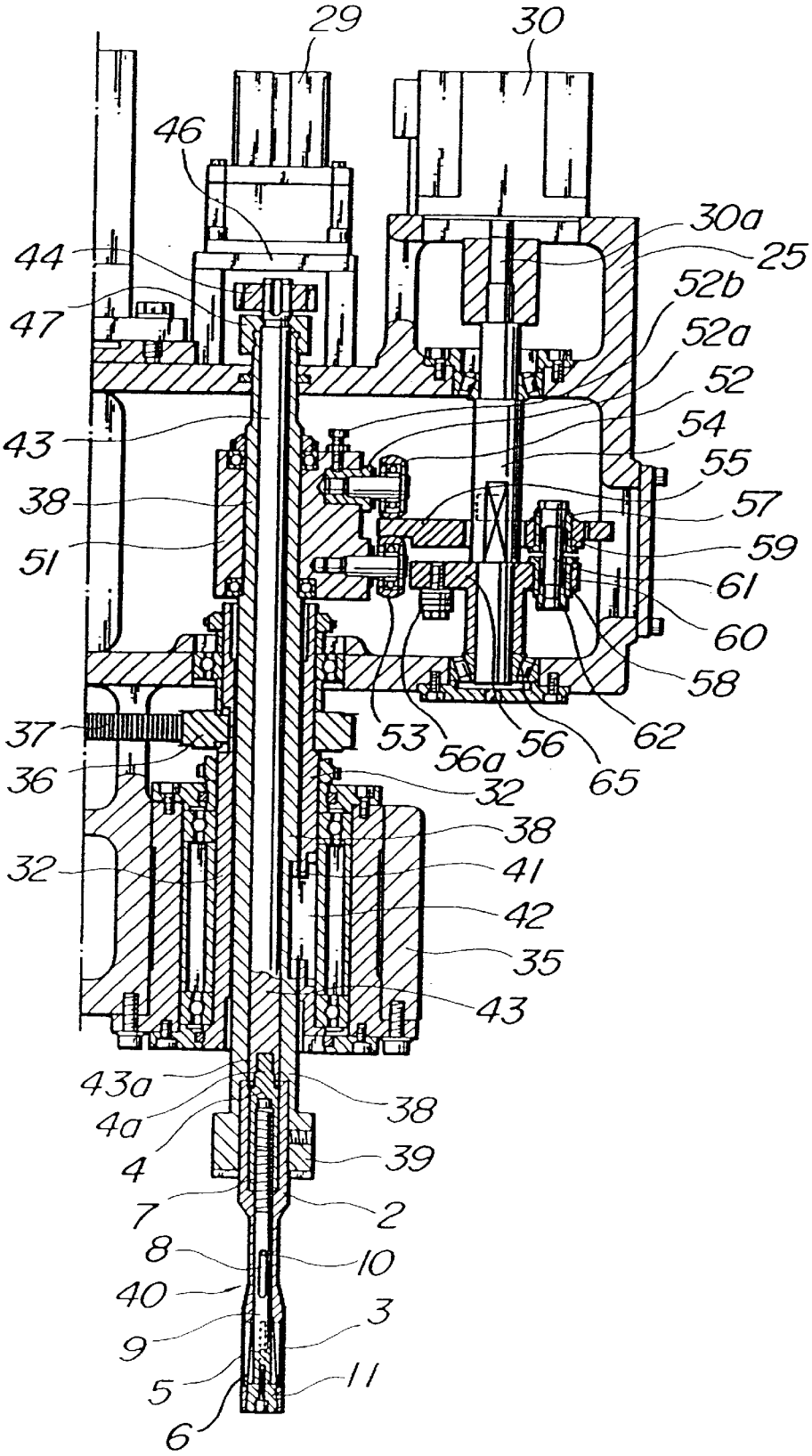
FIG. 4 is a longitudinal sectional side view showing a reamer drive unit of the same.
Figure 5:
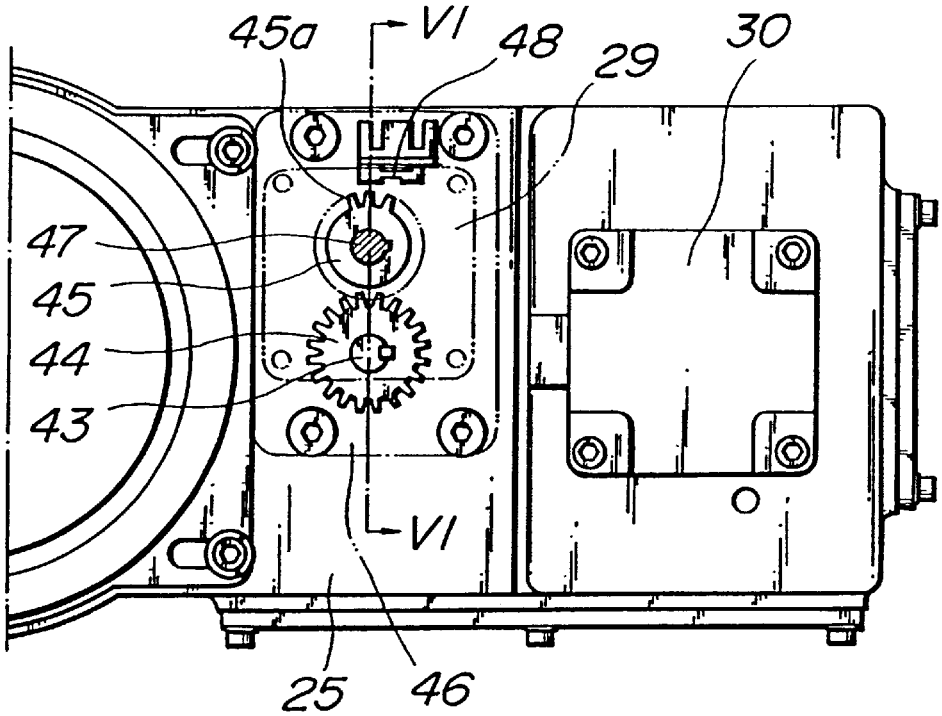
FIG. 5 is a partial plan view showing the bore finishing machine, without a motor for adjustment of the diameter of the reamer's grinding section in expansion/contraction.

A hollow main rotation spindle 38 having a holder 39 for a reamer 40 at its lower end is inserted through the aforesaid rotation cylinder 32 from the inside of the housing 25 to a position where the holder 39 protrudes below beyond a bearing member 35. As shown in FIG. 4, the main rotation spindle 38 is movably engaged to the rotation cylinder 32 in an axial direction via a key way 41 situated axially in a side section thereof and a key member 42 fitted thereinto from the rotation cylinder side, so as to be driven to rotate with the rotation cylinder 32 via the key member 42.

Inside the aforesaid main rotation spindle 38 there is inserted a rotation spindle 43 for diameter expansion which is used for expansion/contraction of the outer diameter of the aforesaid grinding section 3 of the reamer 40. The rotation spindle 43 has a pinion 44 on its upper end projecting from the main rotation spindle 38. The lower end of the rotation spindle 43 is formed into a joint 43*a* to provide connection with the aforesaid rotation shaft 4 in the body of the reamer 40 inside the main rotation spindle 38. Adjacent to the aforesaid pinion 44 there is also provided an intermittent gear 45 which is mounted on a drive shaft 47 of the aforesaid adjusting motor 29 situated on a seat 46 on the housing. On the intermittent gear 45 there is partially formed a required number of teeth 45*a* for meshing with teeth of the pinion at every turn to rotate the pinion 44 together with the aforesaid rotation spindle 43 by a set rotation angle.

Facing the intermittent gear 45, a proximity switch 48 is provided as a localization sensor, which detects the positions of tooth tips and sends out a signal to halt activation of the aforesaid adjusting motor 29 so that the intermittent gear 45 is always halted out of meshing points to keep the pinion 44 in a free state.

Incidentally, although the teeth 45*a* are formed on one section of the periphery in this illustrated example, they may be arranged on two opposite sections. In this case, the teeth 45*a* are to mesh with the pinion 44 at every half turn; therefore, one full turn of the intermittent gear 45 gives twice the rotation angle to the rotation spindle 43, allowing the expanding/contracting operations for the outer diameter of the reamer 40 to be carried out by that much faster.

Figure 6:
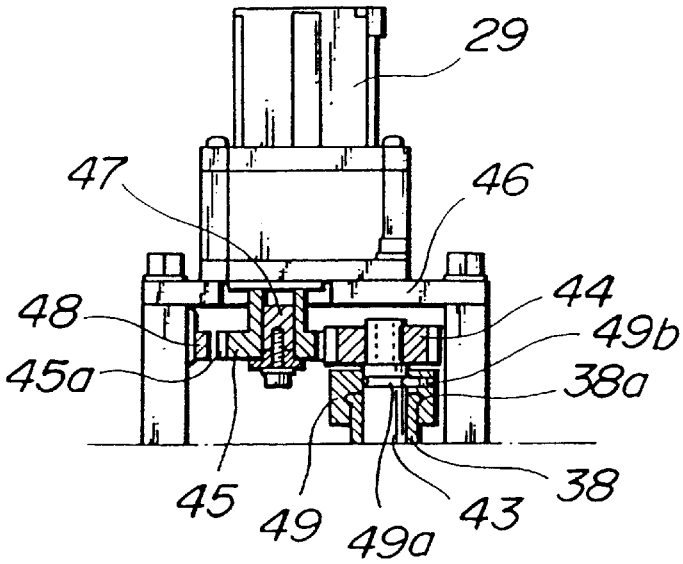
FIG. 6 is a partial longitudinal sectional side view taken along line VI—VI in FIG. 5.

As shown in FIG. 6, the upper end section of the rotation spindle 43 under the aforesaid pinion 44 and the upper end of the main rotation spindle 38 are connected via a member 49, a pin 49*b* screwed from the member 49 into an annular groove 49*a* provided in the rotation spindle 43, and a flange 38*a* formed on the end of the main rotation spindle 38, so as to be moved together in axial directions.

Figure 7:
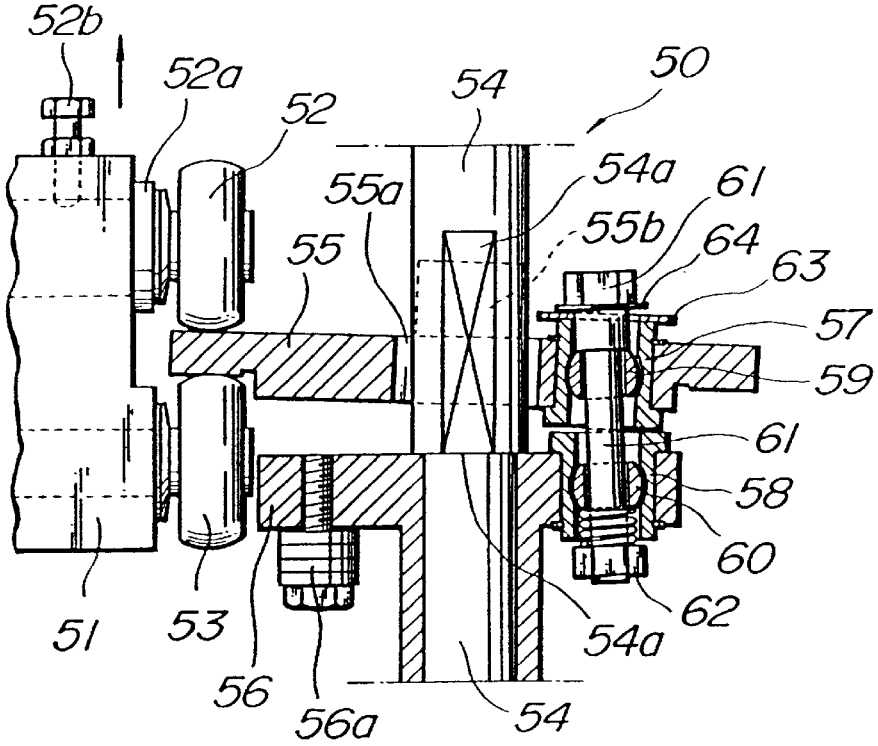
FIG. 7 is a longitudinal sectional side view of a vibration applicator for the main rotation spindle.
Figure 8:
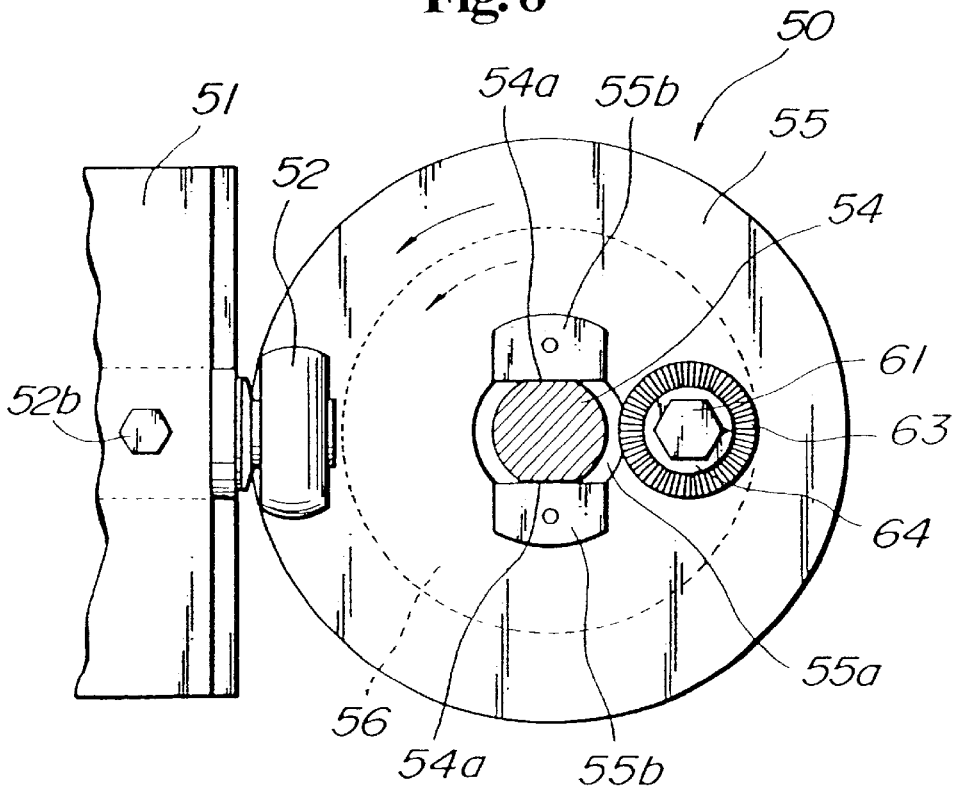
FIG. 8 is a plan view of the same.
Figure 9:
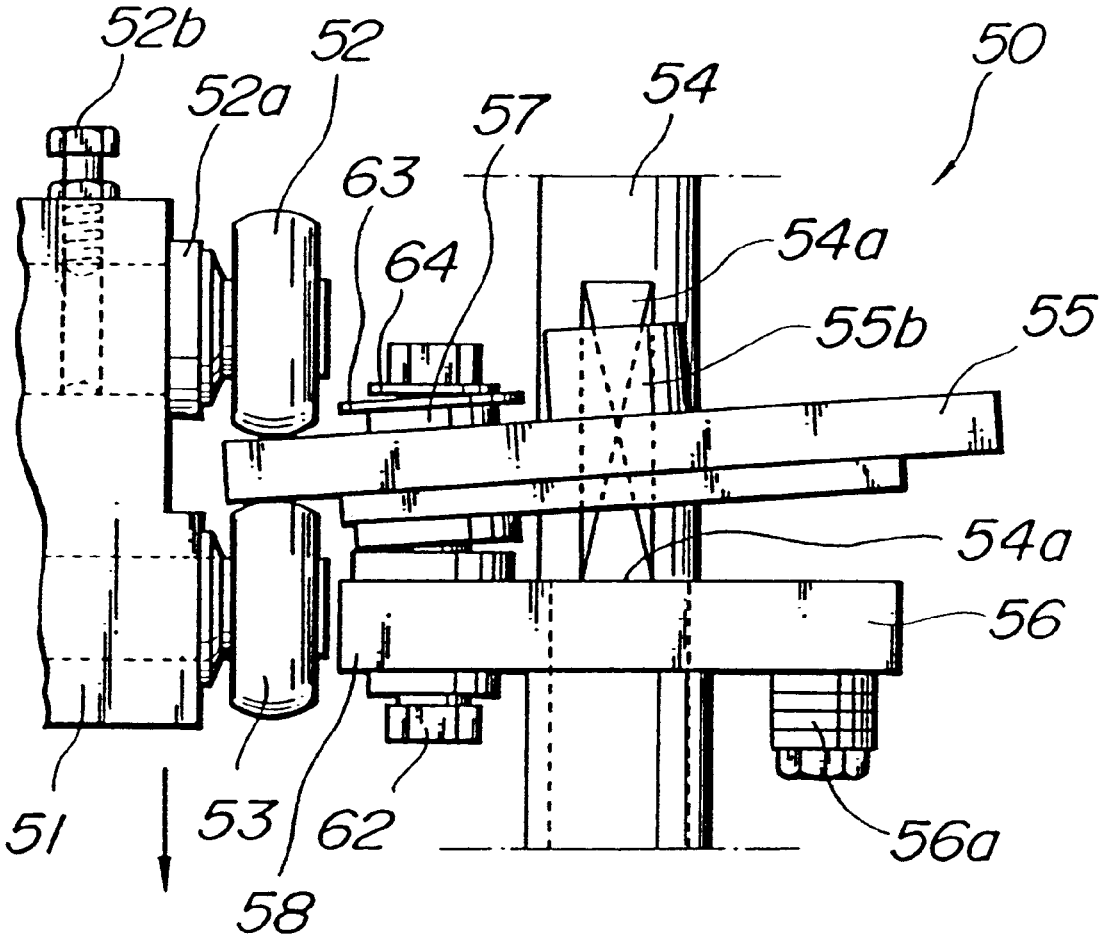
FIG. 9 is a side view showing the vibration applicator with the vibrating disk inverted.

Reference numeral 50 indicates a vibration applicator for the main rotation spindle 38. As shown in FIG. 4, FIG. 7 and the following drawings, the vibration applicator 50 is composed of a block-shaped vibrating member 51, a pair of upper and lower sandwich-supporting rollers 52, 53, a spinning shaft 54, a vibrating disk 55, a rotating disk 56, and a joint. The vibrating member 51 rotatably holds the upper section of the main rotation spindle 38 passing therethrough. The sandwich-supporting rollers 52 and 53 are provided on one side of the vibrating member 51 and are spaced by a sandwiching gap. The spinning shaft 54 with a stepped section 45*a* is longitudinally provided inside the housing 25 to face the sandwich-supporting rollers 52 and 53 and is connected with a drive shaft 30*a* of the aforesaid motor 30, in a manner parallel to the main rotation spindle 38. The vibrating disk 55 has a hole section 55*a* fitted by insertion with the spinning shaft 54 allowing it to freely move up and down and freely rotate with the spinning shaft 54. In addition, the vibrating disk 55 has its periphery inserted in the aforesaid sandwiching gap and is connected via the sandwich-supporting rollers 52 and 53 to the vibrating member 51. The rotating disk 56 is fitted and immovably attached to the stepped section 45*a* of the spinning shaft 45 below the vibrating disk 55, being spaced from the vibrating disk 55 by a required gap, and the lower end of the disk 56 is received by a bearing 65. The joint provides connection between the rotating disk 56 and the aforesaid vibrating disk 55 at their eccentric sections to support the vibrating disk 55 slantingly against the rotating disk 56. The joint is also used for slanting adjustment of the vibrating disk 55 with the connecting point as the fulcrum. In addition, at the opposite side of the connecting point of the rotating disk 56 there is provided a balancing weight 56*a* to prevent run-out in rotation by offset of the eccentric load of the connecting point at the eccentric section.

The sandwiching gap for the aforesaid vibrating disk 55 can be easily adjusted by placing the upper sandwich-supporting roller 52 on the vibrating member 51 with the shaft section thereof rotatably supported by an eccentric bearing 52*a*. The rotation of the eccentric bearing 52*a* produces vertical displacement; therefore, rotational shifting of the eccentric bearing 52*a* with a set screw 52*b* loosened can set the sandwiching gap to match the tilt angle of the vibrating disk 55.

Chamfers 54*a* are applied to the aforesaid spinning shaft 54 on both side surfaces to which the vibration disk 55 is fitted by insertion. The aforesaid hole section 55*a* of the vibrating disk 55 is partially formed to be parallel at opposite internal edges, and receiving members 55*b* are provided on both internal edges so that the vibrating disk 55 rotates together with the spinning shaft 54 by means of the contacts between the receiving members 55*b* and the aforesaid chamfers 54*a*.

The aforesaid joint is composed of: sleeves 57 and 58 fitted to hole sections in the eccentric sections of the vibrating disk 55 and the rotating disk 56, respectively; spherical bearings 59 and 60 installed in the respective sleeves; a connecting shaft 61 consisting of a bolt inserted across the vibrating disk 55 and the rotating disk 56 and passing through the bearings; and a nut member 62 screw threaded thereto.

The aforesaid joint further comprises: a circular scale plate 63 fixed to the upper end of the sleeve 57 on the vibrating disk side; and an index plate 64 situated on the connecting shaft 61 to project from a side facing the scale plate 63. This allows the aforesaid vibrating disk 55 to be set at an angle based on the degree of rotation of the connecting shaft shown by the aforesaid scale plate 63 and the index plate 64.

In a bore finishing machine of the above-described constitution, the aforesaid reamer 40 can be easily mounted on the aforesaid main rotation spindle 38 by inserting the reamer 40 into the holder 39, engaging the connecting terminal 4*a* on the external end of the aforesaid rotation shaft 4 with the joint 43*a* at the lower end of the aforesaid rotation spindle 43, and setting the shuttle section 2 in the aforesaid holder 39 with a screw.

In a bore finishing machine of the above-described constitution, the grind finishing, etc. using the reamer 40 can easily be performed by transmitting the rotating force of the main motor 28 to the rotation cylinder 32 via the transmission shaft 31, pulleys 34, 36, and timing belt 37. In the rotation cylinder 32, the rotation is transmitted to a section between the upper and lower bearings, avoiding rotation run-out which tends to occur in cases where the transmission is performed at the shaft ends. Accordingly, rotation of the main rotation spindle 38 together with the rotation cylinder 32 by means of the key member 42 is also prevented from rotation run-out; therefore, eccentric rotation of the reamer 40 can be prevented to perform grind finishing with higher accuracy.

Furthermore, the main rotation spindle 38 is vibrated up and down within a set stroke range (0~3 mm) by the vibrating member that holds the upper section of the shaft passing therethrough. This up-and-down vibration is achieved by rotating the spinning shaft 54 with the aforesaid motor 30 to vibrate the reamer. That is, when the spinning shaft 54 is rotated, the coaxial vibrating disk 59 and rotating disk 60 are rotated together without rotation run-out by the balancing weight 56, so that the periphery of the disk with the vertical displacement due to slanting is transmitted through between the aforesaid sandwich-supporting rollers. In this process, either one of the rollers 52 and 53 sandwich-supporting the periphery is pressed upward or downward at every turn, which vertically vibrates the vibrating member 51, and the main rotation spindle 38 as well. The up-and-down vibration of the main rotation spindle 38 in turn vertically vibrates the aforesaid reamer 40 mounted on the holder 39 at the shaft end, so that the grind finishing is performed under rotation and vertical vibration.

Adjustment of the outer diameter of the grinding section 3 of the reamer 40 can be achieved as follows. First, the main motor 28 is braked and stopped to forcedly interrupt transmission of the rotating force to the rotation cylinder 32 via the transmission shaft 31, pulleys 34, 36, and timing belt 37. After maintaining the main rotation spindle 38 in a fixed state with the rotation cylinder 32, the adjustment can be preformed by operating the adjusting motor 29. The adjusting motor 29 is activated to rotate the intermittent gear 45, every turn of which rotates the pinion 44 with the rotation spindle 43. The rotation shaft 4 is fittedly attached to the shaft end of the rotation spindle 43 inside the reamer; therefore, the rotation shaft 4 is rotated inside the shuttle 2 with the rotation spindle 43. Thereby, the slide shaft 9 having the threaded shaft 7 screw threaded thereonto is shifted as described above due to the screw lead, the guide hole 8 and the guide pin 10, so that the diameter expansion member 11 expands/contracts the grinding section 3 in diameter. Accordingly, it becomes possible to mechanically carry out the expansion/contraction of the outer diameter of the grinding section 3, which has been accomplished in the past either with jigs or manually. It also becomes possible to adjust the outer diameter of the grinding section 3 arbitrarily and with higher accuracy by controlling the number of rotations and the angle of rotation.

With this expansion/contraction adjustment of the grinding section of the reamer, the grinding accuracy can be improved to allow easier super high precision bore finishing which has been difficult by the conventional method of manual adjustment.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A bore finishing machine comprising a reamer with adjustable expansion/contraction, further comprising:

a hollow main rotation spindle for grinding, having a holding section for a reamer body at its lower end and being rotatably supported with a housing to be oriented longitudinally, said housing held with a column so as to be freely liftable upward and downward;

a rotation spindle for expansion/contraction of the diameter of the reamer, which is inserted and supported rotatably inside said main rotation spindle, having a pinion on the upper end of said rotation spindle and projecting from said main rotation spindle and having the lower end formed into a joint for connection with a rotation shaft in the reamer body, said connection being provided inside said main rotation spindle;

an intermittent gear for intermittent meshing with said pinion to rotate said pinion with said rotation spindle by a set rotational angle, said intermittent gear further comprising a tooth tip;

a localization sensor which detects the position of said tooth tip of said intermittent gear and sends out a signal to halt the activation of a drive source for said intermittent gear so that said intermittent gear is always halted out of the meshing point;

a main motor for rotation of said main rotation spindle via a transmission mechanism, said main motor being situated on said housing; and a motor for rotation of said rotation spindle via said intermittent gear and said pinion, wherein the rotational motion of said rotation shaft at the lower end of said rotation spindle from said motor is converted into linear motion of a slide shaft screw-threaded with said rotation shaft inside the reamer so that a diameter expansion member on one end of said slide shaft inside the reamer body is capable of adjusting the outer diameter of the grinding section of said reamer, wherein:

said transmission mechanism is composed of a rotation cylinder which drives said main rotation spindle and is rotatably supported with said housing while being oriented longitudinally, a transmission shaft arranged in said housing so as to be parallel to said rotation cylinder and connected with the drive shaft of said main motor, pulleys integrally arranged on said transmission shaft and on said rotation cylinder at its outer periphery between the rotatably supported sections, respectively, and a belt wound around said pulleys; and said rotation cylinder has said main rotation spindle inserted therethrough, and said main rotation spindle is connected with the rotation cylinder via a key member so as to be integral with the rotation cylinder in a rotating direction and movable in an axial direction so that said main rotation spindle can be freely rotated and vertically moved with said rotation spindle for diameter expansion/contraction accomplished inside thereof.

2. The bore finishing machine comprising a reamer with adjustable expansion/contraction according to claim 1, further comprising a vibration applicator for said rotation main spindle composed of;

a vibrating member in a block shape for rotatably holding an upper section of said main rotation spindle passing therethrough;

a pair of upper and lower sandwich-supporting rollers provided on one side of said vibrating member and spaced apart by a sandwiching gap;

a spinning shaft longitudinally provided inside said housing, which faces the sandwich-supporting rollers and is parallel to said main rotation spindle;

a vibrating disk fitted to said spinning shaft with its periphery inserted in said sandwiching gap in a freely tiltable manner and connected with said vibrating member via said pair of sandwich-supporting rollers;

a rotating disk fitted and immovably attached to a lower section of said spinning shaft below said vibrating disk, being spaced from said vibrating disk by a required gap; and a joint for connection between said rotating disk and said vibrating disk at their eccentric sections to support said vibrating disk slantingly against said rotating disk with the connecting point as the fulcrum.

3. The bore finishing machine comprising a reamer with adjustable expansion/contraction according to claim 2, wherein said joint is composed of:

sleeves fitted to hole sections at the eccentric sections of said vibrating disk and said rotating disk, respectively;

spherical bearings installed in said respective sleeves;

a connecting shaft consisting of a bolt inserted across the vibrating disk and the rotating disk so as to pass through said bearings; and a nut.

4. The bore finishing machine comprising a reamer with adjustable expansion/contraction according to claim 1, wherein said joint is composed of:

sleeves fitted to hole sections at the eccentric sections of said vibrating disk and said rotating disk, respectively;

spherical bearings installed in said respective sleeves;

a connecting shaft consisting of a bolt inserted across the vibrating disk and the rotating disk so as to pass through said bearings; and a nut.

5. The bore finishing machine comprising a reamer with adjustable expansion/contraction according to claim 4, wherein said joint further comprises a circular scale plate fixed to the upper end of said sleeve on said vibrating disk side, and an index member provided on said connecting shaft projecting from a side facing the scale plate, so as to set said vibrating disk at an angle based on the degree of rotation of said connecting shaft indicated by said scale plate and said index member.

6. The bore finishing machine comprising a reamer with adjustable expansion/contraction according to claim 1, further comprising a vibration applicator for said rotation main spindle composed of:

a vibrating member in a block shape for rotatably holding an upper section of said main rotation spindle passing therethrough;

a pair of upper and lower sandwich-supporting rollers provided on one side of said vibrating member and spaced apart by a sandwiching gap;

a spinning shaft longitudinally provided inside said housing, which faces the sandwich-supporting rollers and is parallel to said main rotation spindle;

a vibrating disk fitted to said spinning shaft with its periphery inserted in said sandwiching gap in a freely tiltable manner and connected with said vibrating member via said pair of sandwich-supporting rollers;

a rotating disk fitted and immovably attached to a lower section of said spinning shaft below said vibrating disk, being spaced from said vibrating disk by a required gap; and a joint for connection between said rotating disk and said vibrating disk at their eccentric sections to support said vibrating disk slantingly against said rotating disk with the connecting point as the fulcrum.

7. The bore finishing machine comprising a reamer with adjustable expansion/contraction according to claim 1, wherein said joint is composed of:

sleeves fitted to hole sections at the eccentric sections of said vibrating disk and said rotating disk, respectively;

spherical bearings installed in said respective sleeves;

a connecting shaft consisting of a bolt inserted across the vibrating disk and the rotating disk so as to pass through said bearings; and a nut.

8. The bore finishing machine comprising a reamer with adjustable expansion/contraction according to claim 7, wherein said joint further comprises a circular scale plate fixed to the upper end of said sleeve on said vibrating disk side, and an index member provided on said connecting shaft projecting from a side facing the scale plate, so as to set said vibrating disk at an angle based on the degree of rotation of said connecting shaft indicated by said scale plate and said index member.

* * * * *